United States Patent [19]

Chernosky

[11] 4,436,328

[45] Mar. 13, 1984

[54] KEYLESS LOCK

[76] Inventor: John E. Chernosky, 5 Malcolm St., West Babylon, N.Y. 11704

[21] Appl. No.: 351,288

[22] Filed: Feb. 22, 1982

[51] Int. Cl.[3] ..... E05C 5/02

[52] U.S. Cl. ..... 292/67; 292/241

[58] Field of Search ..... 292/241, 242, 114, 109, 292/63, 67, 57, 207

[56] References Cited

U.S. PATENT DOCUMENTS 1,741,252 12/1929 Shapiro ..... 292/57 X 3,811,718 5/1974 Bates ..... 292/241

*Primary Examiner*—Richard E. Moore

*Attorney, Agent, or Firm*—Michael I. Kroll

[57] ABSTRACT

An improved keyless lock is provided and consists of a helical spring, a rectangular housing, a latch, a latch release, a retaining ring, a rectangular keeper and a plurality of screws. The rectangular housing has a plurality of mounting holes, a recessed central square aperture surrounded by an annular lip on top, a slot in a long side wall and an open bottom. The latch consists of a round portion having a square aperture, a tongue on one side and a corner stop on the other side. The latch release has a finger grip handle and a shaft with the square mating portion. The rectangular keeper has a plurality of mounting holes on top, a pair of slots, each slot is in each long side wall, an open bottom and a tab on the underside of the top of the rectangular keeper between one slot.

5 Claims, 6 Drawing Figures

KEYLESS LOCK

BACKGROND OF THE INVENTION

The instant invention relates generally to a locking device apparatus and more particularly it relates to a device for locking windows, doors or the like without using a key. The locking mechanism is built into the apparatus itself.

It is a known fact that a person can purchase locking devices for windows or doors in a hardware store. These devices either have inadequate locking means or are provided with standard lock and key systems. This situation is not always desirable and accordingly it is in need of an improvement.

SUMMARY OF THE INVENTION

A principle object of the present invention is to provide an improved keyless lock that can operate without the use of a key.

Another object is to provide an improved keyless lock that can be mounted easily to a window or door.

An additional object is to provide an improved keyless lock that will pull loose fitting window sashes together for a tighter butt.

A further object is to provide an improved keyless lock that is economical in cost.

A still further object is to provide an improved keyless lock that is easy to use.

Further objects of the invention will appear as the description proceeds.

DESCRIPTION OF THE PREFERRED EMBODIMENTS

Figure 1:
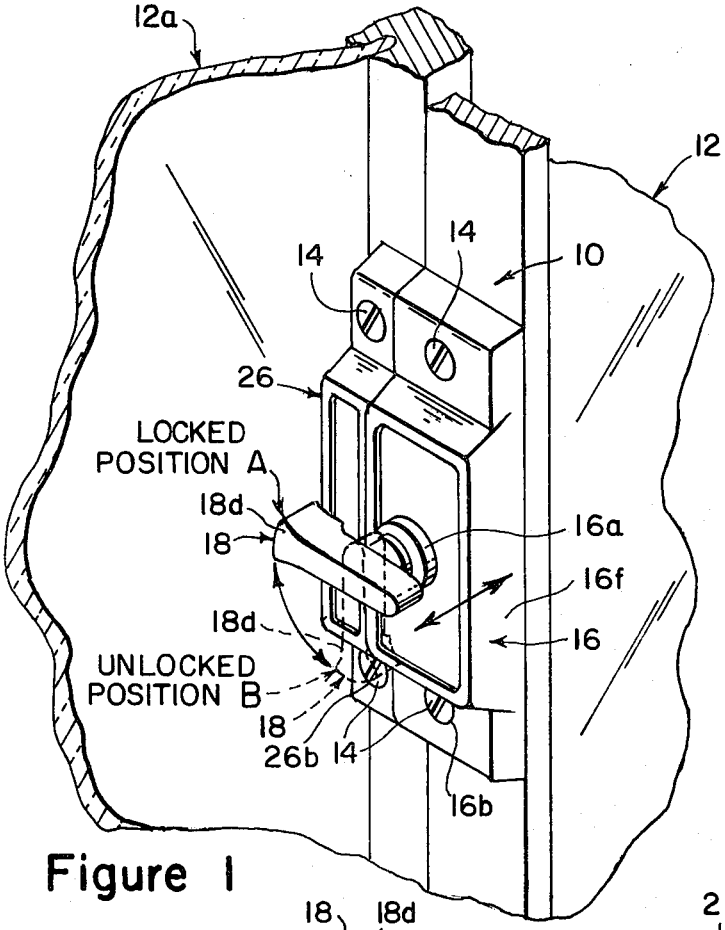
FIG. 1 is a isometric view of the invention mounted in place for use.
Figure 2:
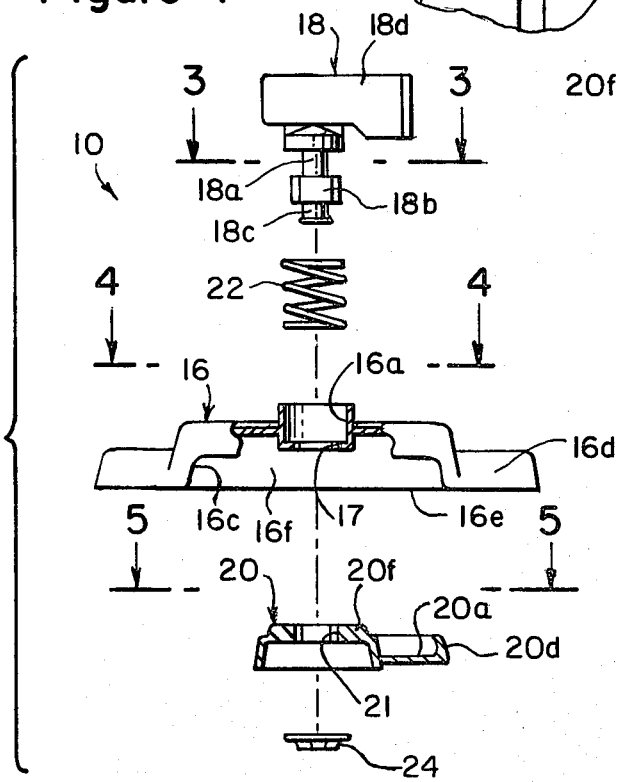
FIG. 2 is an exploded view of the invention with parts broken away.

Turning now descriptively to the drawings, in which similar reference characters denote similar elements throughout the several views, FIGS. 1 and 2 illustrates an improved keyless lock 10. The lock 10 consists of the parts as best shown in FIG. 2. They are a latch release 18, a helical spring 22, a rectangular housing 16, a latch 20 and a retaining ring 24.

The latch release 18 has a finger grip handle **18*d* and a shaft 18*a* with a square mating portion 18*b* above the end portion 18*c* of the shaft. The rectangular housing 16 has a plurality of mounting holes 16*b* (see FIG. 1), a recessed central square aperture 17 surrounded by an annular lip 16*a* on top, a slot 16*c* in a long side wall 16*d* and an open bottom 16*e*. The latch 20 consists of a round portion 20*f* having a square aperture 21, a tongue 20*a* on one side and a corner stop 20*e* (see FIG. 5**) on the other side.

To assemble the improved keyless lock 10 the latch release 18 is placed through the helical spring 22, the square aperture 17 in the housing 16 and the square aperture 21 in the latch 20 so that the finger grip handle **18*d* is in line with the tongue 20*a* of the latch 20. The retaining ring 24 is then pressed onto the end portion 18*c* of the shaft of the latch release 18. As shown in FIG. 1 the improved keyless lock 10 is attached to the window frame 12 by screws 14 that go through the mounting holes 16*b* of the rectangular housing 16**.

Figure 3:
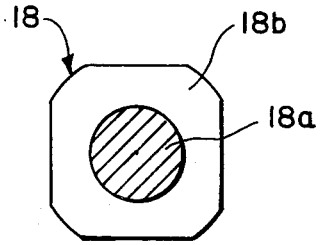
FIG. 3 is an enlarged cross sectional view of the latch release taken along line 3—3 in FIG. 2.

FIG. 3 of the drawing is an enlarged cross sectional view taken through the shaft **18*a* of the latch release 18 showing in detail the square mating portion 18*b*** with rounded corners.

Figure 4:
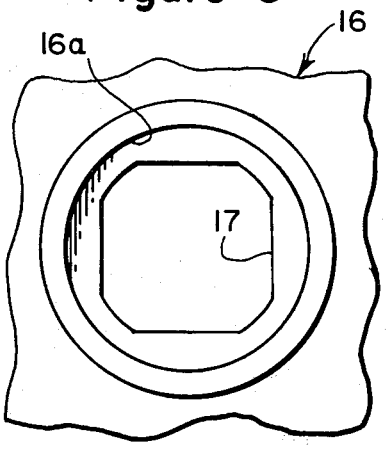
FIG. 4 is an enlarged detail view of part of the housing taken along line 4—4 in FIG. 2.

FIG. 4 of the drawing is an enlarged detail of the recessed central square aperture 17 surrounded by the annular lip **16*a* on the top of the rectangular housing 16**.

Figure 5:
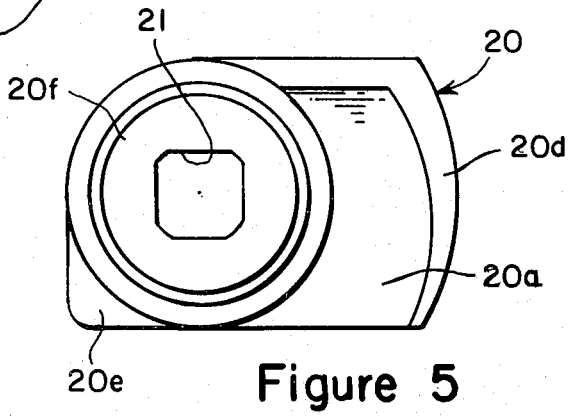
FIG. 5 is a plan view of the latch taken along line 5—5 in FIG. 2.

FIG. 5 is a plan view of the latch 20 showing the round portion **20*f*, the square aperture 21, the tongue 20*a* and the corner stop 20*e***.

To operate the improved keyless lock 10 the finger grip handle **18*d* is depressed, compressing the helical spring 22. The square mating portion 18*b* of the latch release 18 will disengage from the square aperture 17 of the housing 16 allowing the latch release 18 and the latch 20 to rotate to a locked position A (FIG. 1) through the slot 16*c* in the long side wall 16*d* of the housing 16. The corner stop 20*e* will engage the solid long wall 16*f* of the housing 16 preventing further rotation. When pressure is released from the latch release 18 the mating portion 18*b* will return to the square aperture 17 locking and preventing rotation of the latch 20. To go to an unlocked position B as shown in dotted in FIG. 1**, reverse the steps.

Figure 6:
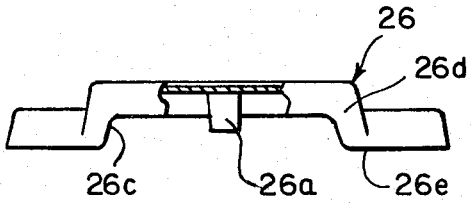
FIG. 6 is a side view of the keeper with parts broken away.

FIGS. 1 and 6 further illustrate a rectangular keeper 26 having a plurality of mounting holes **26*b* on top, a pair of slots 26*c*, each slot is on each long side wall 26*d* and an open bottom 26*e*. A tab 26*a* is on the underside of the top of the rectangular keeper 26 between one slot 26*c*. As shown in FIG. 1 the rectangular keeper 26 is attached to another window frame 12*a* by screws 14 that go through the mounting holes 26*b* of the rectangular keeper 26. The back of the tab 26*a* will ride the radius edge 20*d* of the tongue 20*a* of the latch 20 to pull the rectangular keeper 26 towards the rectangular housing 16** for a tighter butt.

The improved keyless lock 10 is made of metal but any other material such as plastic, etc. can be used.

While the form of apparatus herein described constitutes a preferred embodiment of the invention, it is understood that the invention is not limited to this precise form of apparatus and that changes may be made therein without departing from the scope of this invention.

Having regard to the foregoing disclosure the following is claimed as the inventive and patentable embodiments thereof:

1. An improved keyless lock which comprises:

(a) a helical spring;

(b) a rectangular housing having a plurality of mounting holes, a recessed central square aperture surrounded by an annular lip on top, a slot in a long side wall and an open bottom;

(c) a latch consisting of a round portion having a square aperture, a tongue on the one side and a corner stop on other side;

(d) a latch release having a finger grip handle and a shaft with a square mating portion placed through said helical spring, said square aperture in said housing and said square aperture in said latch so that said finger grip handle is in line with said tongue of said latch;

(e) means for fastening said latch release to said latch so that when said finger grip handle is depressed compressing said helical spring, said square mating portion of said latch release will disengage with said square aperture of said housing allowing said latch release and said latch to rotate to a locked position through said slot in said long side wall of said housing whereby said corner stop engages the solid long wall of said housing preventing further rotation; and (f) means for mounting said rectangular housing to a frame.

2. An improved keyless lock as recited in claim 1, wherein said means for fastening said latch release to said latch is a retaining ring pressed onto the end portion of said shaft of said latch release.

3. An improved keyless lock as recited in claim 2, wherein said means for mounting said rectangular housing to a frame is a plurality of screws.

4. An improved keyless lock as recited in claim 3, further comprising:

(a) a rectangular keeper having a top a plurality of mounting holes on said top, for mounting said rectangular keeper for a second frame an open bottom, and a tab on the underside of said top of said rectangular keeper so that the back of said tab will ride a radius edge of said tongue of said latch to pull said rectangular keeper towards said rectangular housing for a tighter butt.

5. An improved keyless lock as recited in claim 4, wherein said means for mounting said rectangular keeper to a second frame is a plurality of screws.

* * * * *